US009341388B2

(12) United States Patent
Francescon

(10) Patent No.: US 9,341,388 B2
(45) Date of Patent: May 17, 2016

(54) SLIDING FOUNDATION VENT

(71) Applicant: Christopher Michael Francescon, Nashville, TN (US)

(72) Inventor: Christopher Michael Francescon, Nashville, TN (US)

( * ) Notice: Subject to any disclaimer, the term of this patent is extended or adjusted under 35 U.S.C. 154(b) by 0 days.

(21) Appl. No.: 14/035,143

(22) Filed: Sep. 24, 2013

(65) Prior Publication Data

US 2015/0082721 A1 Mar. 26, 2015

Related U.S. Application Data

(60) Provisional application No. 61/704,697, filed on Sep. 24, 2012.

(51) Int. Cl.
*E04B 5/48* (2006.01)
*F24F 13/12* (2006.01)

(52) U.S. Cl.
CPC ..... *F24F 13/12* (2013.01)

(58) Field of Classification Search
CPC ..... F24F 13/12; E04B 1/70
USPC ..... 49/38; 52/302.1, 302.4, 302.6, 302.7, 52/302.3
See application file for complete search history.

(56) References Cited

U.S. PATENT DOCUMENTS

| | | | | | |
|---|---|---|---|---|---|
| 14,798 | A * | 5/1856 | Bruff | 49/38 | |
| 104,717 | A * | 6/1870 | Eich | 49/38 | |
| 314,393 | A * | 3/1885 | Paradise | 49/38 | |
| 1,559,377 | A * | 10/1925 | Riker | E06B 7/02 | 49/38 |
| 1,598,610 | A * | 9/1926 | Hufschmidt | B60K 11/085 | 165/98 |
| 1,638,847 | A * | 8/1927 | Hansen | 165/98 | |
| 1,762,223 | A * | 6/1930 | Gross | 49/38 | |
| 1,818,268 | A * | 8/1931 | Noblitt | 165/99 | |
| 1,860,648 | A * | 5/1932 | Bokan | 160/114 | |
| 2,201,830 | A * | 5/1940 | Hoffer | E06B 7/08 | 160/225 |
| 3,046,719 | A * | 7/1962 | Tropiano | 55/417 | |
| 3,393,627 | A * | 7/1968 | Eurich | F24F 13/12 | 454/324 |
| 3,509,812 | A * | 5/1970 | James | F24F 13/12 | 454/332 |
| 4,033,073 | A * | 7/1977 | Bogan | 49/38 | |
| 4,754,696 | A * | 7/1988 | Sarazen et al. | 454/256 | |
| 4,962,649 | A * | 10/1990 | Battocletti | 62/256 | |
| 5,120,273 | A * | 6/1992 | Lin | E06B 7/02 | 454/195 |
| 5,487,701 | A * | 1/1996 | Schedegger et al. | 454/271 | |
| 5,496,213 | A * | 3/1996 | Miller | 454/271 | |

(Continued)

FOREIGN PATENT DOCUMENTS

| | | | | |
|---|---|---|---|---|
| EP | 0032207 A1 * | 7/1981 | E06B 7/02 | |
| EP | 0154671 A3 * | 1/1987 | F24F 13/12 | |
| GB | 204701 A * | 8/1924 | F24F 13/12 | |

*Primary Examiner* — Charles A Fox
*Assistant Examiner* — Joseph J Sadlon
(74) *Attorney, Agent, or Firm* — Hornkohl Intellectual Property Law, PLLC; Jason L. Hornkohl

(57) ABSTRACT

A foundation vent includes four panels arranged to form a box-shaped vent frame. Ten frame vanes are attached to the box-shaped frame. A vent shutter having ten shutter vanes with elongated oval-shaped finger grips positioned centrally on the shutter vanes is held in a slider channel positioned on the box-shaped vent frame. The slider channel is formed by a series of six tabs centrally positioned in an opening between two adjacent frame vanes. The vent shutter is held in the slider channel so that it slides with respect to the box-shaped vent frame to selectively expose openings in between the frame vanes. A locking mortar track in provided on all four panels of the box-shaped frame to securely hold it in place. The vent is preferably constructed from polypropylene copolymer that is talc reinforced and sized to evenly course with a standard size brick.

7 Claims, 5 Drawing Sheets

(56) References Cited

U.S. PATENT DOCUMENTS 6,446,876 B1 * 9/2002 Stefano et al. ..... 236/49.3
6,574,932 B2 * 6/2003 Layne et al. ..... 52/302.4
7,270,498 B1 * 9/2007 Albanese et al. ..... 405/104
7,823,349 B2 * 11/2010 Alexander ..... 52/302.1
7,870,698 B2 * 1/2011 Tonyan et al. ..... 52/483.1
2003/0208975 A1 * 11/2003 Regina ..... 52/306
2012/0291221 A1 * 11/2012 Amin ..... H02G 3/185
16/2.2

* cited by examiner

SLIDING FOUNDATION VENT

CROSS-REFERENCES TO RELATED APPLICATIONS

The present application claims the benefit of and priority from Provisional Patent Application No. 61/704,697 filed Sep. 24, 2012.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

Most common foundation vents are black plastic sliders that are thin and flimsy or a thin aluminum that bends, rusts, and is not very functional. Current thin slider vents are generally unstable without the buildup of mortar around the opening which tends to block the air flow and prevent the slider from sliding and functioning properly.

Current vents also rarely function properly due to improper installation and foundational structure and do not course out with the majority of brick sizes sold residentially.

BRIEF SUMMARY OF THE INVENTION

An embodiment of the present invention is directed toward a vent, that includes four panels arranged to form a box-shaped vent frame. Frame vanes are attached to the box-shaped frame with frame openings formed in between the vanes. A vent shutter having shutter vanes with elongated oval-shaped finger grips positioned centrally on the vanes is held in a slider channel constructed on the box-shaped vent frame. The slider channel is preferably formed by a series of tabs centrally positioned in the openings between two adjacent frame vanes. The vent shutter is held in the slider channel so that it slides with respect to the box-shaped vent frame to selectively open or close the openings in between the frame vanes. A locking mortar track in provided on all four panels of the box-shaped frame to securely hold it in place. The vent is preferably constructed from a polypropylene copolymer that is talc reinforced and sized to course with standard sized bricks.

DETAILED DESCRIPTION OF THE INVENTION

The present invention is directed toward a foundation vent that includes a boxed, plastic slider with a locking mortar track and a novel profile that provides for enhanced appearance and functionality. The locking mortar track preferably is a u-shaped channel that extends around the entire circumference of the fully boxed slider vent. The channel allows mortar to enter the channel whereby the vent, is locked in position. The foundation vents are designed to go on residential block, brick, or concrete formed foundations. They operate manually by sliding open to allow air flow and breathability in a warm climate or closed to reduce cold damp air in the winter. The slider vent of the present invention is very durable, will last indefinitely, and can be used as a replacement for any existing vents.

Figure 1:
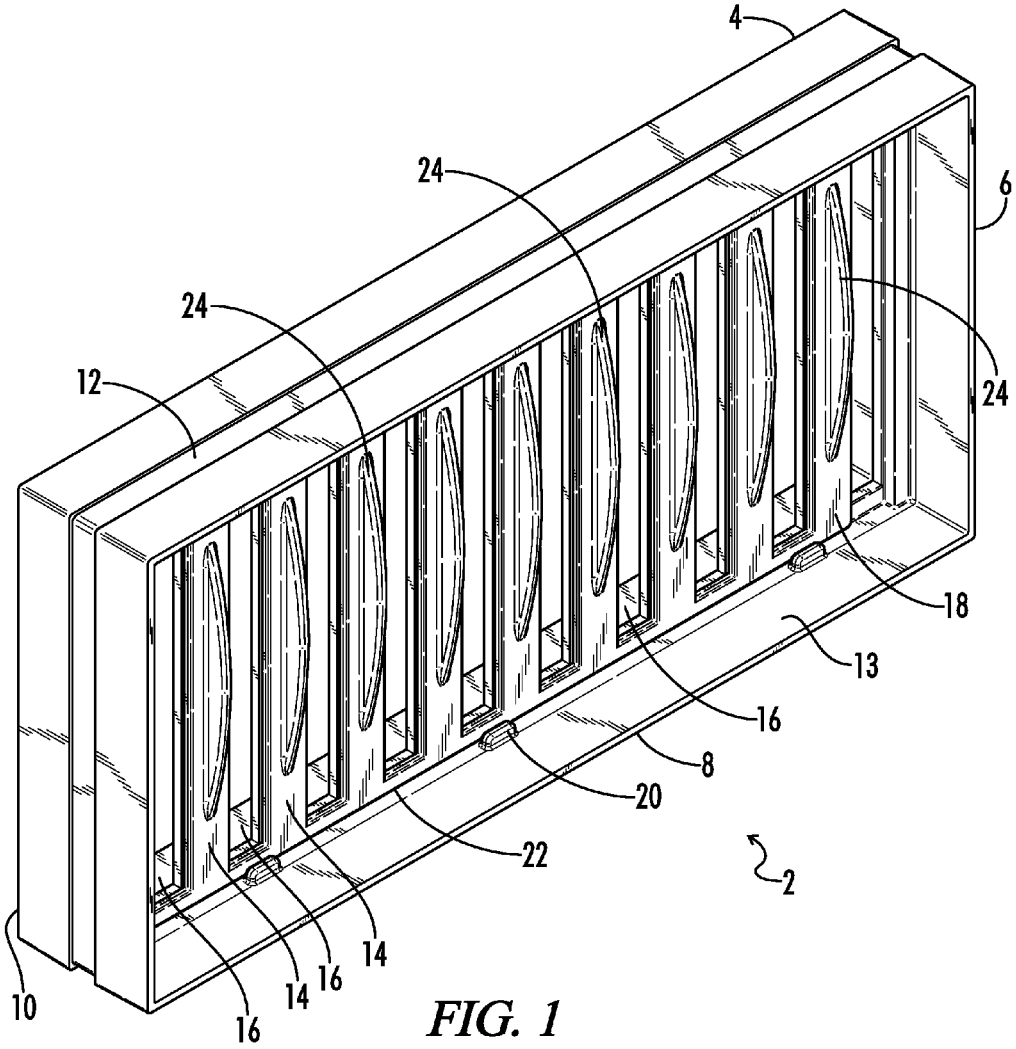
FIG. 1 is an isometric front view of a vent constructed in accordance with the present invention.
Figure 2:
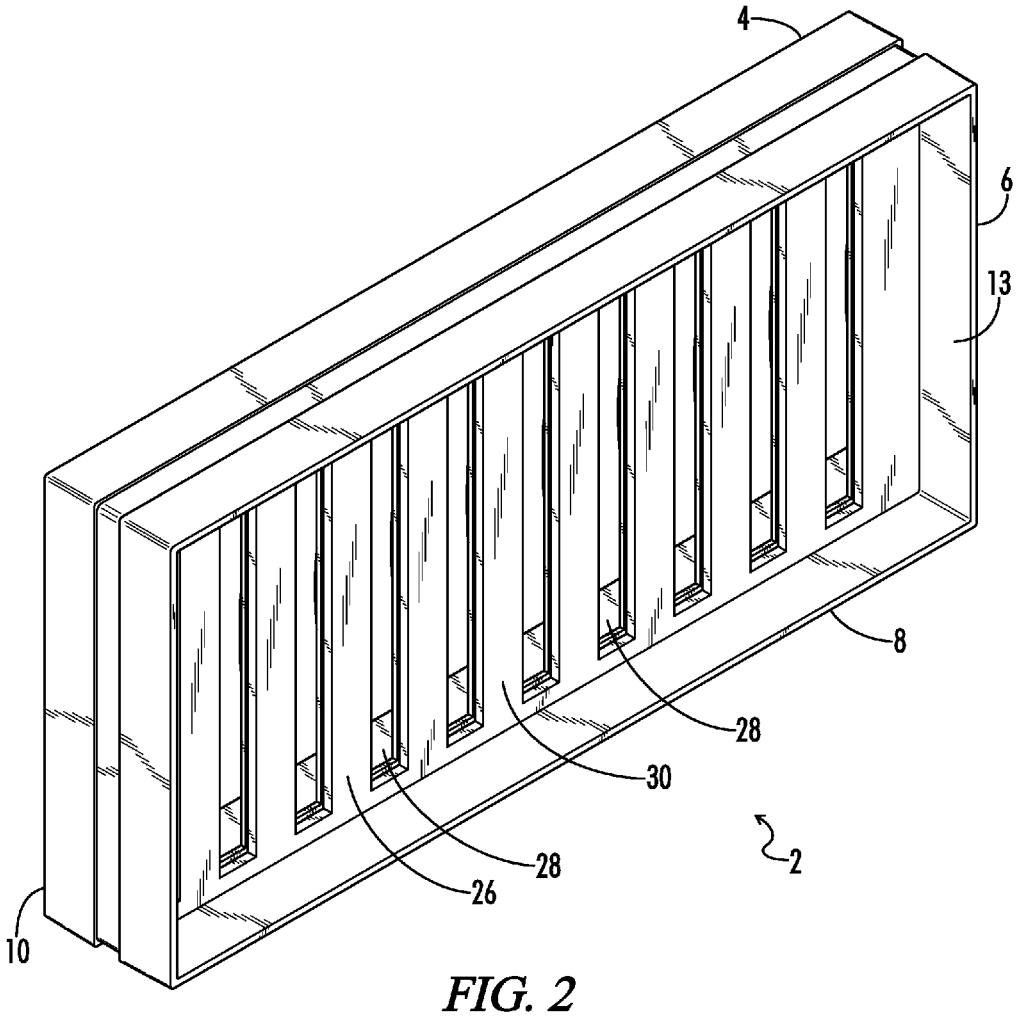
FIG. 2 is an isometric back view of a vent constructed in accordance with the present invention.
Figure 3:
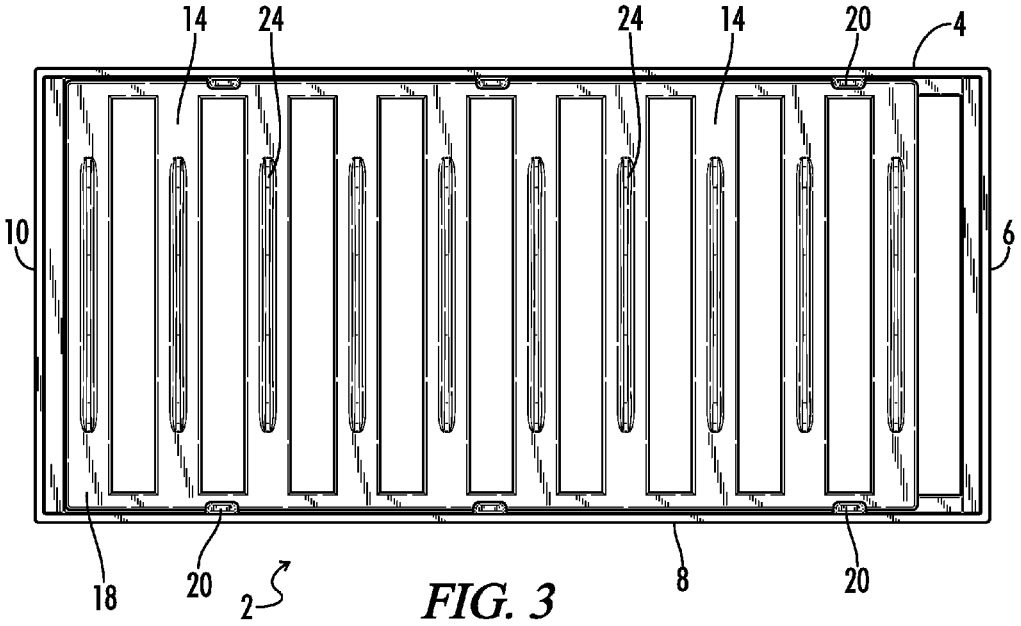
FIG. 3 is a front view of a vent constructed in accordance with the present invention.
Figure 4:
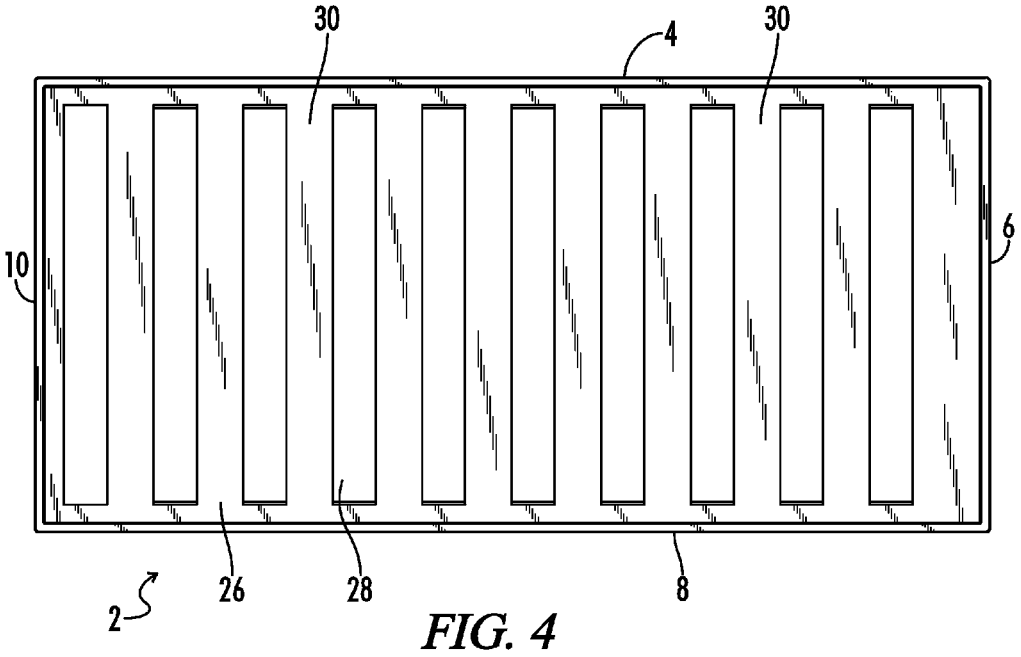
FIG. 4 is a back view of a vent constructed in accordance with the present invention.
Figure 5:
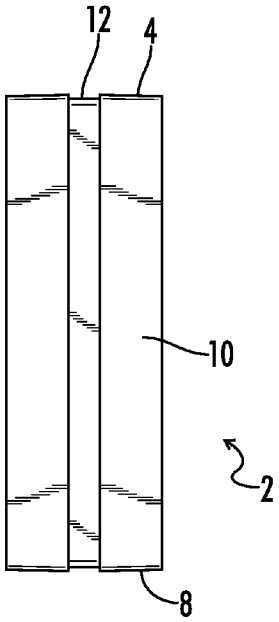
FIG. 5 is a side view of a vent constructed in accordance with the present invention.
Figure 6:
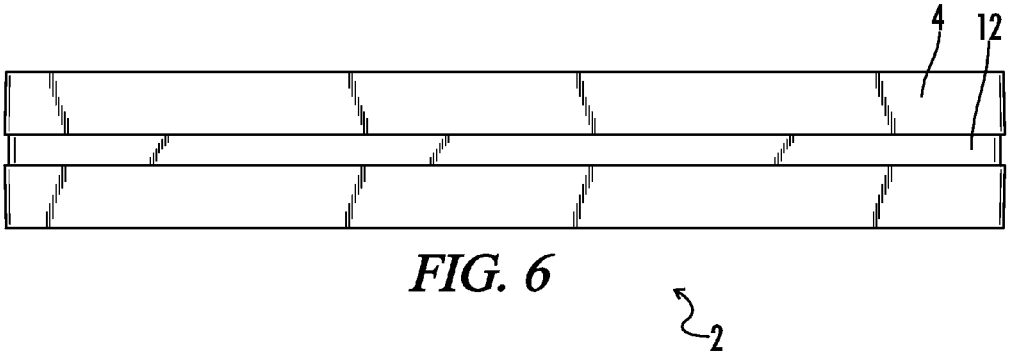
FIG. 6 is a top or bottom view of a vent constructed in accordance with the present invention.

Referring now to FIGS. 1-6, a vent 2 constructed in accordance with the present invention is shown. The vent 2 includes four panels 4, 6, 8 and 10 arranged to form a box-shaped vent frame. Unlike prior plastic sliding vents, the present vent is fully boxed, with exterior panels 4, 6, 8 and 1.0 on all four sides. This provides for a much more stable vent mounting and prevents mortar from building up around the base of the vent and preventing it from sliding. A locking mortar track 12, best shown in FIGS. 5 and 6, surrounds the exterior of the box-shaped frame on all four exterior sides. In the embodiment of FIG. 1, ten vent vanes 14 are positioned inside the box-shaped frame with vent openings 16 in between to form a sliding vent shutter 18. A screen or mesh can be positioned to cover the vent openings 16 if desired. The vent shutter 18 comprised of the ten vent vanes 14 is received by a slider channel 22 formed between protrusions 20 positioned along the interior surface 13 of the top 4 and bottom 8 panels of the vent 2 and a vent frame 26, shown in the rear views of FIGS. 2 and 4. The shutter vanes 14 have elongated finger grips 24 positioned centrally on, and extending outward from the front surface of, the shutter vanes 14 them to assist in gripping the vent shutter 18. The slider channel 22 holds the vent shutter 18 such that the shutter 18 slides with respect to the vent frame 26 and panels 4, 6, 8 and 10 to open or close the vent openings 28 in the vent frame 26.

the slider channel 22 is preferably constructed from six tabs 20 or protrusions and each of the six tabs 20 is preferably positioned on the interior surface 13 of the panels 4 and 8 of the vent 2 within the box-shaped frame such that each tab 20 is centered in front of a vent opening 28 formed between two adjacent vent frame 26 vanes 30. Additional or reduced draft can be added to the vent shutter 18 or vent frame 26 openings if desired for any particular application. All six tabs 20 for the slider are preferably positioned on the panels 4 and 8 such that they are centered with respect to the nearest opening 28. This helps to prevent a bad steel condition around the standing steel in the mold required to make the tab 20. In addition, the curved edge of tab 20 allows the use of a mold shutoff that is not cupped.

The vent 2 is preferably constructed from a molded plastic and the four panels 4, 6, 8 and 10 can be constructed from a single molded piece if desired. In such and embodiment, ejector pins are preferably provided on the side of the vent shutter 18 with the finger grips 24 to assist in the molding process. The vents 2 are most preferably constructed with a polypropylene copolymer that is black and 20% talc reinforced. The surface finish is most preferably a 39 on the facing surfaces of the part and a 27 on the sliding surfaces and back of the part, as measured on the Charmille EDM scale.

Figure 7:
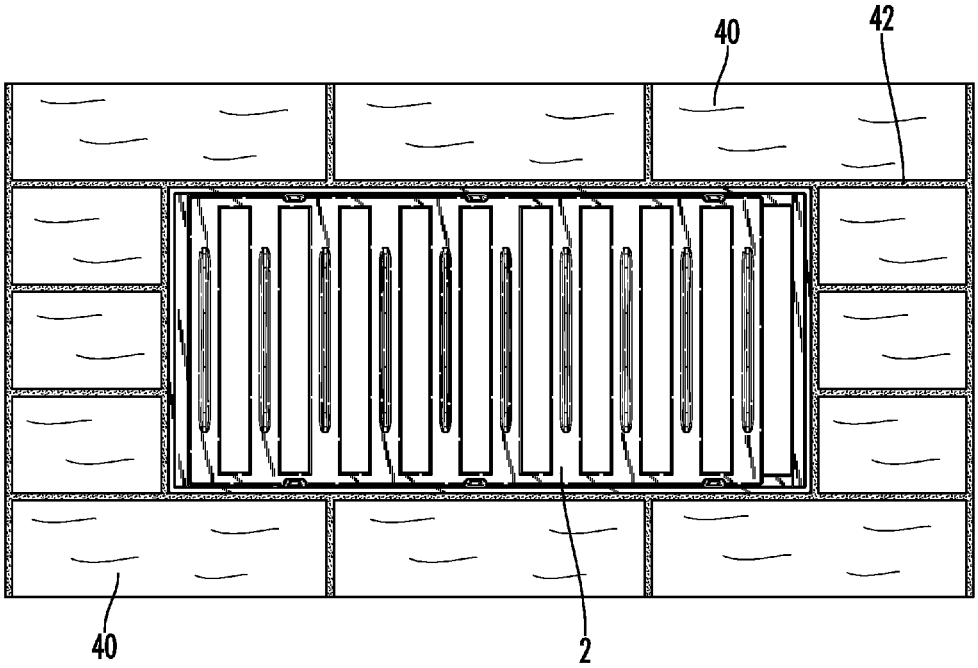
FIG. 7 is an illustration of a vent constructed in accordance with the present invention coursing with a standard size brick.

The vent 2 most preferably comes in two preferred sizes which allows for a cleaner faster install. As shown in FIG. 7, the vents 2 are sized to course brick-to-brick 40 to allow for a continuous mortar joint without cutting any brick 40 for a cleaner look in the wall and much faster and easier installation.

The smaller size is designed to course out with a standard 8" block (7.5×15.5 actual) and a standard and modular size brick (S/S & M/S). The large size is designed to course out with queen and king sized brick (Q/S & K/S). Both vent 2 sizes are preferably sized and designed to course out with three courses of brick 40 and two approximately ⅜" mm joints 42.

The slider vent of the present invention provides a simple, cost-effective solution to many long recognized problems for homeowners, masons and contractors and is unique in several ways. Both sizes are completely boxed for strength and stability, which is not used in any other plastic designs. The vents have a locking mortar track on all four sides for easy and secure installation. This firmly locks the vent into place with a regular mortar joint for a permanent, stable and functional vent. The vent also has a unique sliding design and oval profile on the grid slider, that looks better, is stronger, and opens and closes easier due to the tabs and structural stability.

Although there have been described particular embodiments of the present invention of a new and useful SLIDING FOUNDATION VENT, it is not intended that such references be construed as limitations upon the scope of this invention except as set forth in the following claims.

What is claimed is:

1. A vent, said vent comprising:

four panels arranged to form a box-shaped vent frame;

a plurality of frame vanes attached to said box shaped frame;

a vent shutter having a plurality of shutter vanes having elongated oval-shaped finger grips extending outward from a front surface of said shutter vanes;

a slider channel formed on an interior surface of said box-shaped vent frame said slider channel comprising at least one integrally molded plastic tab that extends outward from said interior surface of said box-shaped vent frame such that said at least one molded plastic tab holds said vent shutter in said box-shaped vent frame such that said vent shutter slides with respect to said box-shaped vent frame; and a locking mortar track formed on an exterior surface of all four panels of said box-shaped frame;

wherein said slider channel and said vent shutter are enclosed within an interior of said box-shaped frame.

2. The vent of claim 1 wherein said slider channel further comprises a series of tabs wherein each of said tabs is positioned on said interior surface of said box-shaped vent frame such that said tab is centered with respect to an opening formed between two of said frame vanes.

3. The vent of claim 1 wherein said slider channel further comprises six tabs wherein each of said six tabs is positioned on said interior surface of said box-shaped vent frame such that said tab is centered with respect to an opening formed between two of said frame vanes.

4. The vent of claim 1, wherein said vent is constructed from a polypropylene copolymer that is talc reinforced.

5. The vent of claim 1 wherein said box-shaped frame is sized to evenly course with a standard sized brick.

6. The vent of claim 1 wherein said vent shutter is constructed from a unitary piece of plastic.

7. A molded plastic foundation vent, said vent comprising:

four plastic panels arranged to form a box-shaped vent frame;

a plurality of plastic frame vanes attached to said box-shaped frame;

a molded plastic vent shutter having a plurality of shutter vanes wherein said molded plastic vent shutter is formed from a single piece of molded plastic;

a slider channel formed on an interior surface of said box-shaped vent frame said slider channel comprising at least one molded plastic tab that extends outward from said interior surface of said box-shaped vent frame such that said at least one molded plastic tab holds said molded plastic vent shutter in said box-shaped frame such that said molded plastic vent shutter slides with respect to said box-shaped vent frame; and a locking mortar track formed on all four panels of said box-shaped frame wherein said slider channel and said shutter frame are enclosed within said an interior of said box-shaped frame;

wherein said slider channel and said vent shutter are enclosed within an interior of said box-shaped vent frame; and wherein said at least one molded plastic tab and at least one of said plastic panels are constructed from a single unitary piece of plastic.

* * * * *